US006422220B1

(12) United States Patent
Lepp et al.

(10) Patent No.: US 6,422,220 B1
(45) Date of Patent: Jul. 23, 2002

(54) INTERNAL COMBUSTION ENGINE WITH AN EXHAUST GAS RECIRCULATION SYSTEM

(75) Inventors: Noel R. Lepp, Peoria, IL (US); Cho Y. Liang, West Lafayette, IN (US); Steven R. McCoy, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/739,495

(22) Filed: Dec. 18, 2000

(51) Int. Cl.[7] ..... F02M 25/07
(52) U.S. Cl. ..... 123/568.12; 123/568.18
(58) Field of Search ..... 123/568.11, 568.12, 123/568.17, 568.18, 568.2

(56) References Cited

U.S. PATENT DOCUMENTS 4,179,892 A * 12/1979 Heydrich ..... 60/605.2
4,285,318 A * 8/1981 Yoneda et al. ..... 123/568.29
5,802,846 A 9/1998 Bailey
6,062,027 A * 5/2000 Landfahrer et al. ..... 60/605.2

* cited by examiner

*Primary Examiner*—Gene Mancene
*Assistant Examiner*—Arnold Castro
(74) *Attorney, Agent, or Firm*—Taylor & Aust. P.C.

(57) ABSTRACT

An internal combustion engine system, particularly suitable for a motor vehicle, is provided with an intake manifold, an exhaust manifold and an exhaust gas recirculation rate control system fluidly connected to the exhaust manifold and to the intake manifold. The exhaust gas recirculation rate control system includes at least two critical-flow nozzles, each critical-flow nozzle having an intake end and output end, the intake ends being fluidly coupled to the exhaust manifold; at least one valve, each valve being fluidly coupled with at least one output end; and a control module operatively connected to each valve for controlling exhaust gas flow therethrough. Some advantages of such a system is that the exhaust gas recirculation is accurately provided with an "open-loop" control system, thereby avoiding the use of a feedback system; the flow can be accurately determined under a choked-flow operating conditions; and the system can readily handle different exhaust gas flow rates.

20 Claims, 5 Drawing Sheets

EQ 1

$$\dot{m} = \frac{C_D A P_{uo}}{\sqrt{R T_{uo}}} \gamma^{1/2} \left( \frac{2}{\gamma + 1} \right)^{\frac{\gamma+1}{2(\gamma-1)}}$$

For $P_1/P_{uo} \leq PR_c$

EQ 2

$$\dot{m} = \frac{C_D A P_{uo}}{\sqrt{R T_{uo}}} \frac{\gamma^{1/2} M}{\left( 1 + \frac{\gamma - 1}{2} M^2 \right)^{\frac{\gamma+1}{2(\gamma-1)}}}$$

For $P_1/P_{uo} > PR_c$

INTERNAL COMBUSTION ENGINE WITH AN EXHAUST GAS RECIRCULATION SYSTEM

TECHNICAL FIELD

The present invention relates to internal combustion engines, and, more particularly, to internal combustion engines with an exhaust gas recirculation system.

BACKGROUND ART

An exhaust gas recirculation (EGR) system is used for controlling the generation of undesirable pollutant gases and particulate matter in the operation of internal combustion engines. Such systems have proven particularly useful in internal combustion engines used in motor vehicles such as passenger cars, light duty trucks, and other on-road motor equipment. EGR systems primarily recirculate the exhaust gas by-products into the intake air supply of the internal combustion engine. The exhaust gas which is reintroduced to the engine cylinder reduces the concentration of oxygen therein, which in turn lowers the maximum combustion temperature within the cylinder and slows the chemical reaction of the combustion process, decreasing the formation of nitrous oxides ($NO_x$). Furthermore, the exhaust gases typically contain unburned hydrocarbons which are burned on reintroduction into the engine cylinder, which further reduces the emission of exhaust gas by-products which would be emitted as undesirable pollutants from the internal combustion engine.

When utilizing EGR in a turbocharged diesel engine, the exhaust gas to be recirculated is preferably removed upstream of the exhaust gas driven turbine associated with the turbocharger. In many EGR applications, the exhaust gas is diverted directly from the exhaust manifold. An example of such an EGR system is disclosed in U.S. Pat. No. 5,802,846 (Bailey) issued on Sep. 8, 1998, which is assigned to the assignee of the present invention.

Exhaust gas recirculation (EGR) is very effective in reducing $NO_x$ from a diesel engine, but it also tends to increase particulate matter (PM) emissions. In order to maximize the $NO_x$ reduction, a common practice is to apply as much EGR as possible to the engine in certain regions of the engine operating map with an acceptable increase in particulate matter. Additionally, the recent emission regulations mandate emission compliance under all ambient conditions. These requirements make EGR rate control important to the viability of EGR technology.

An air mass-flow sensor has been used in some engine applications to provide feed back signals for EGR control. However, the accuracy of the current generation of air mass-flow sensors is not accurate enough to meet the EGR control requirements for the heavy duty truck diesel engines. Oxygen sensors are more accurate, but their transient response is not fast enough for feedback control of the EGR rate. In addition, the current generation of these two types of sensors do not meet the durability and reliability requirements of the heavy duty diesel applications.

The present invention is directed to overcoming one or more of the problems as set forth above.

Disclosure of the Invention

In one aspect of the invention, an exhaust gas recirculation rate control system adapted to be fluidly connected to an exhaust manifold and an intake manifold of an internal combustion engine is provided with a plurality of critical-flow nozzles, each critical-flow nozzle having an intake end and an output end, the intake ends being adapted to receive the flow of exhaust gas. At least one valve is provided, with each valve being fluidly coupled with at least one output end, and a control module operatively connected to each valve for controlling exhaust gas flow therethrough.

In another aspect of the invention, an internal combustion engine is provided with an intake manifold, an exhaust manifold and an exhaust gas recirculation rate control system fluidly connected to the exhaust manifold and to the intake manifold. The exhaust gas recirculation rate control system includes at least two critical-flow nozzles, each critical-flow nozzle having an intake end and output end, the intake ends being fluidly coupled to the exhaust manifold; at least one valve, each valve being fluidly coupled with at least one output end; and a control module operatively connected to each valve for controlling exhaust gas flow therethrough.

In yet a further aspect of the invention, a method of controlling a rate of recirculation of an exhaust gas in an exhaust gas recirculation system is provided and includes the steps of providing at least two critical-flow nozzles, each critical-flow nozzle having an intake end and output end; fluidly coupling the intake ends with an exhaust manifold of an internal combustion engine; fluidly coupling at least one valve with at least one corresponding output end and with an intake manifold of the internal combustion engine; operatively connecting a control module to each valve; directing the flow of the exhaust gas into the intake ends; and controlling the amount of the exhaust gas released through each valve.

BEST MODE FOR CARRYING OUT THE INVENTION

Figure 1:
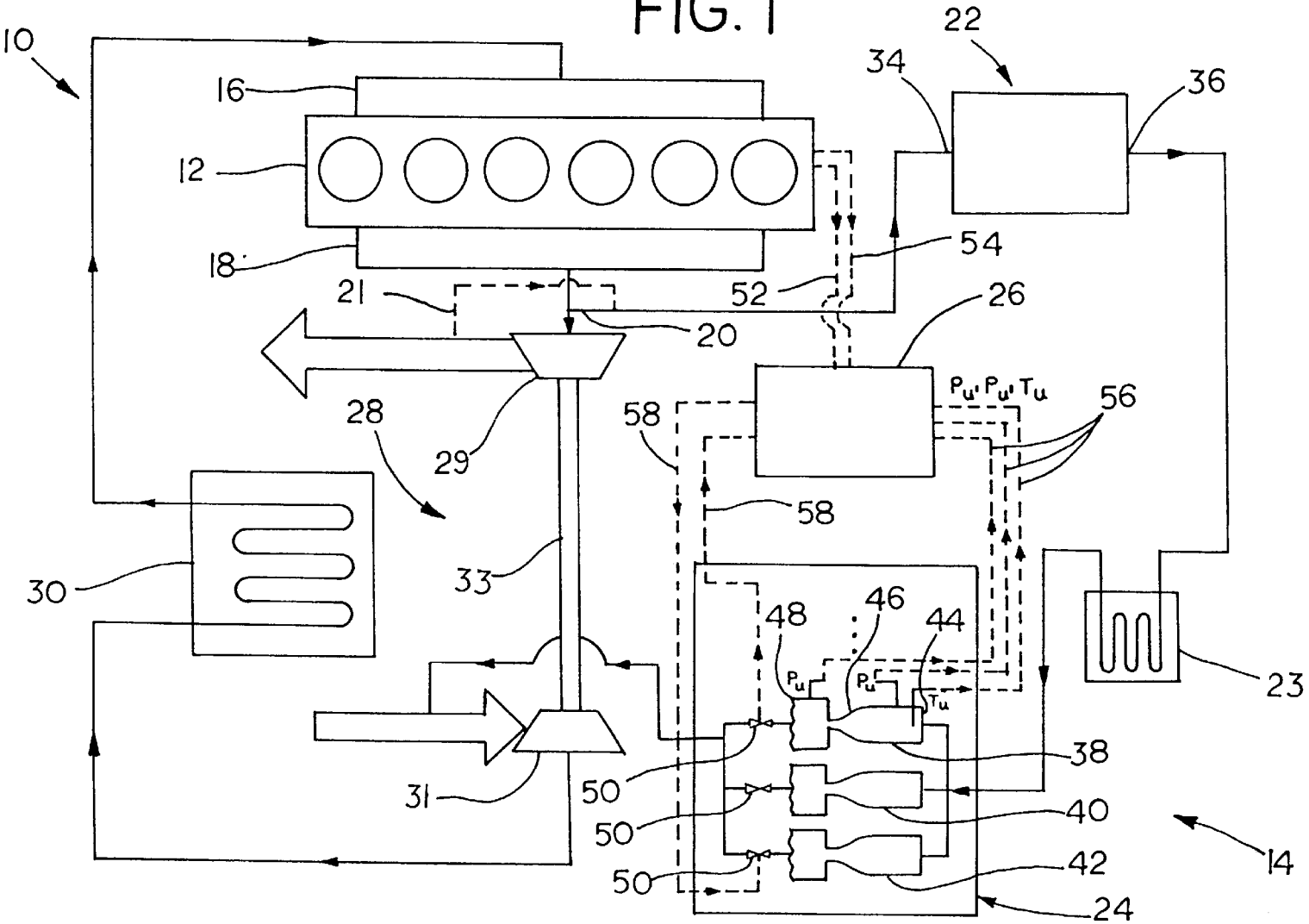
FIG. 1 is a schematic view of an internal combustion engine system including an embodiment of an exhaust gas recirculation system of the present invention.

Referring now to the drawings, and more particularly to FIG. 1, there is shown an embodiment of an internal combustion (IC) engine system 10 which includes an IC engine 12 and an exhaust gas recirculation system 14. IC engine 12 includes an intake manifold 16 and an exhaust manifold 18. EGR system 14 includes an exhaust gas coupling 20, a particulate trap 22, a recirculated exhaust gas cooler 23, an EGR rate control system 24, and an engine control module (ECM) 26. IC engine system 10 further includes a turbocharger 28 and an aftercooler 30. Turbocharger 28 has a turbine 29, a compressor 31 and a shaft 33.

Intake manifold 16 is fluidly coupled in series with aftercooler 30 and compressor 31 in order to receive intake air into IC engine 12. Exhaust manifold 18 of IC engine 12 is fluidly coupled with turbine 29.

Exhaust gas recirculation system 14 is fluidly coupled to exhaust manifold 18 via exhaust gas coupling 20. An alternative embodiment of the exhaust gas coupling, shown in phantom and labeled 21, draws exhaust gas from the exit side of turbine 29. Exhaust gas coupling 20, 21 directs the exhaust gas that is being recirculated to particulate trap 22.

Particulate trap 22 includes an input end 34 through which the recirculated exhaust gas is received, a filter within the body of the particulate trap (not shown), and an output end 36 through which the filtered exhaust gas is channeled. Particulate trap 22 is used to remove soot particles and unburned fuel and lube oil from the exhaust gas being recirculated.

EGR cooler 23 is fluidly coupled with particulate trap 22 to receive the filtered exhaust gas therefrom. EGR cooler 23 cools the filtered exhaust gas before it enters EGR rate control system 24.

EGR rate control system 24 is fluidly coupled directly to EGR cooler 23 and indirectly to particulate trap 22. EGR rate control system 24 includes at least two critical-flow nozzles, of which three such nozzles 38, 40 and 42 are illustrated. Each critical-flow nozzle 38, 40 and 42 has an intake end 44, a throat 46 and an output end 48.

Intake ends 44, of each of critical-flow nozzles 38, 40 and 42 are fluidly coupled in parallel to receive the incoming flow of recirculated exhaust gas. At least one valve 50 is fluidly coupled with output ends 48 of critical-flow nozzles 38, 40 and 42. In the embodiment shown, each output end 48 has a valve 50 associated therewith with each of valves 50 being fluidly coupled in parallel. Alternatively, output ends 48 of critical-flow nozzles 38, 40 and 42 could be fluidly coupled in parallel (not shown) to a single valve 50.

ECM 26 controls the rate at which exhaust gas is recirculated to intake manifold 16 of IC engine 12. Based upon an engine speed signal transmitted via line 52 and an engine load signal transmitted via line 54 from IC engine 12, ECM 26 determines the required EGR rate. ECM 26 calculates the mass flow rate at each nozzle 38, 40 and 42 based either upon stored data or upon pressure and temperature signals transmitted via lines 56 received from at least one of critical-flow nozzles 38, 40 and 42, as schematically indicated. Given the required EGR flow rate and the calculated mass flow rate at each nozzle 38, 40 and 42, ECM 26 operates at least one valve 50 coupled with critical-flow nozzles 38, 40 and 42 by outputting valve control signals via lines 58 in order to provide the required EGR flow rate to IC engine 12.

Figure 2:
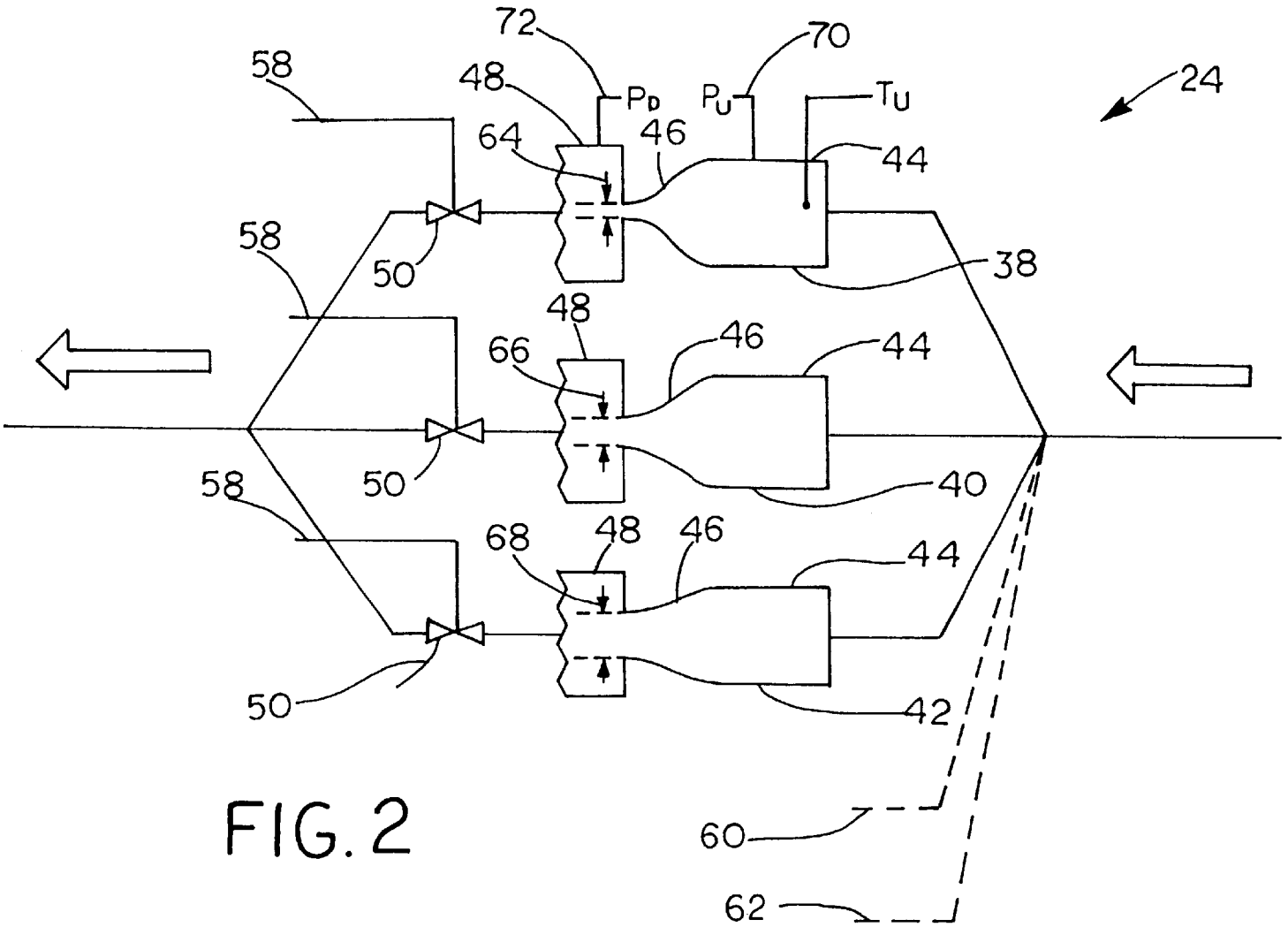
FIG. 2 is a schematic view of the exhaust gas recirculation rate control system of FIG. 1.

A schematic view of EGR rate control system 24 is shown in FIG. 2. Once again, three critical-flow nozzles 38, 40 and 42 are illustrated. Possible further critical-flow nozzles 60 and 62 are shown in phantom. The actual number of critical-flow nozzles provided is a matter of design choice.

In the embodiment shown in FIG. 2, throats 46 of each of critical-flow nozzles 38, 40 and 42 are chosen so as to have a characteristic throat area 64, 66 and 68, respectively. Each of throat areas 64, 66 and 68 are measured at a location where a respective throat 46 narrows to its opening with the respective downstream end 48. Throat areas 64, 66 and 68 are sized differently so as to handle different flow rates.

As seen from a combined view of FIGS. 1 and 2, valve control signals are transmitted over a selected line 58 to one or more valves 50, whereas pressure and temperature signals are only generated at critical-flow nozzle 38 and transmitted via lines 56. Pressure and temperature signals are preferably generated from a single nozzle. To obtain the largest flow range, it is advantageous to generate pressure and temperature signals within the nozzle with the smallest throat area, which corresponds to nozzle 38 in this embodiment. In the embodiment shown in FIG. 2, pressure and temperature signals are generated by an upstream pressure sensor 70, a downstream pressure sensor 72 and an upstream temperature sensor 74.

Pressure and temperature sensors 70, 72 and 74 for EGR rate control system 24 may be optional. For example, for applications where correction for changes in ambient conditions are not required, the upstream pressure, downstream pressure and upstream temperature can be obtained from look-up maps which are provided from engine testing. Another example is for the case where some margin in $NO_x$ reduction is available, where precise measurement of such variables would not be needed. In such an instance pressure and temperature values could again be supplied from look-up maps.

Figures 3, 4:
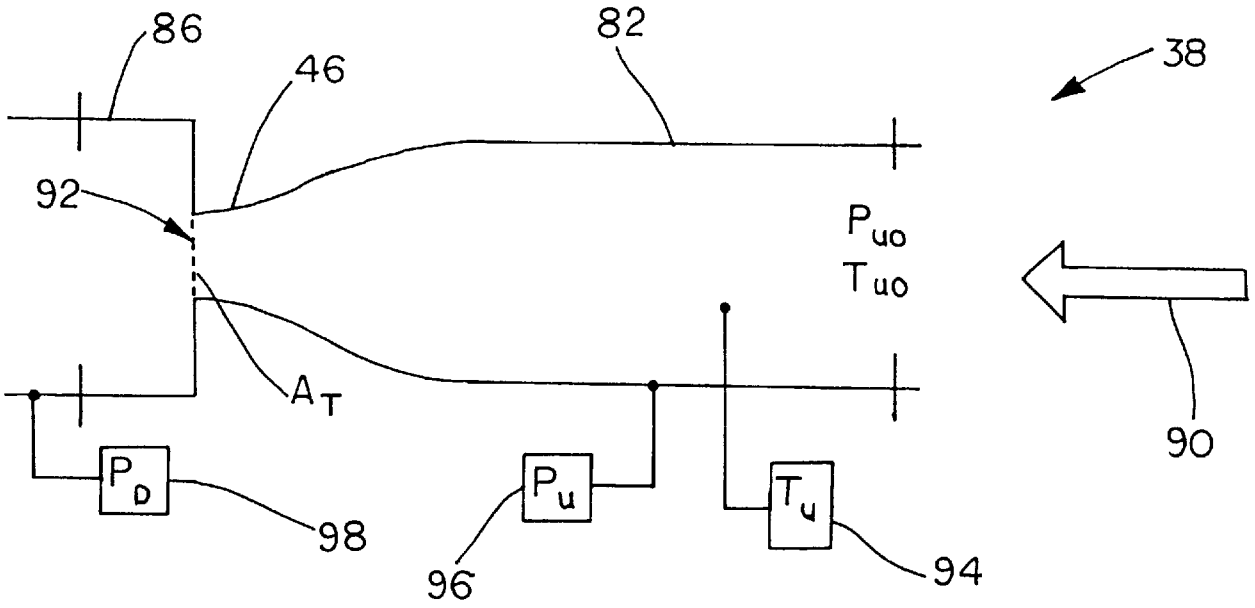
FIG. 3 is a schematic view of a critical-flow nozzle used in the exhaust gas recirculation rate control system of FIGS. 1 and 2.
FIG. 4 is a set of equations for determining EGR mass flow rate using the critical-flow nozzle of FIG. 3.

In the embodiment shown in FIG. 3, a schematic view of a single critical-flow nozzle 38 is illustrated. It is to be understood that other such critical-flow nozzles (i.e., 40 and 42) are configured to operate in a manner similar to critical-flow nozzle 38. Critical-flow nozzle 38 includes an upstream portion 82, a throat 46 and a downstream portion 86. Upstream region 82 further includes an intake zone 88 where EGR flow enters into critical-flow nozzle 80, as indicated by arrow 90.

To determine the mass flow rate of the recirculating exhaust gas through critical-flow nozzle 38, certain variables must be known. These variables include the upstream stagnation pressure and temperature at intake zone 88, $P_{uo}$ and $T_{uo}$; and the throat area $A_t$ at opening 92 where throat 46 opens into downstream portion 86. Other values which may be determined by temperature and pressure sensors 94, 96 and 98 are the upstream temperature $T_u$, the upstream pressure $P_u$ and the downstream pressure $P_d$, respectively.

If the exhaust is diverted directly from exhaust manifold 18, as per FIG. 1, via exhaust gas coupling 20, EGR system 14 is considered a high-pressure loop system. In a high-pressure loop system, the pressure ratio PR, defined as $P_t/P_o$ where $P_t$ is the static pressure at throat 46 and $P_o$ is the stagnation pressure upstream of throat 46, is below a critical pressure ratio $PR_c$. When pressure ratio PR is less than critical pressure ratio $PR_c$, the flow at throat 46 is "choked" (i.e., the flow at throat 46 attends sonic speed). At this critical condition, the gas mass flow rate is only dependent upon the stagnation pressure $P_{uo}$ and temperature $T_{uo}$ at intake zone 88.

However, if the PR is above $PR_c$, the flow at throat 46 is sub-sonic. Such a sub-sonic condition is likely to exist when a low-pressure loop exhaust gas recirculation system is used. In this case, the exhaust gas is drawn from an outlet of turbine 29 by alternately located gas coupling 21 (shown in phantom in FIG. 1). Due to the smaller pressure difference between the outlet of turbine 29 and the inlet of compressor 31, a choked-flow condition at throat 46 is not likely to occur.

When the pressure ratio PR is below critical pressure ratio $PR_c$, the EGR mass flow rate can be determined by equation (1) (FIG. 4). If the pressure ratio PR is above the critical pressure ratio $PR_c$, the gas mass flow rate can be determined by equation (2) (FIG. 4), where:

| | |
|---|---|
| m | =Mass flow rate |
| $C_D$ | =Discharge Coefficient |
| $A_T$ | =Cross-Sectional Area @ Throat |
| $A_u$ | =Cross-Sectional Area Upstream |
| Δ | =Density |
| $P_D$ | =Static Pressure Downstream |
| $P_t$ | =Static Pressure at Throat |
| $P_{uo}$,$T_{uo}$ | =Upstream Stagnation Pressure and Temperature |
| $P_u$,$T_u$ | =Upstream Static Pressure and Temperature |
| R | =Universal Gas Constant |
| ( | =Ratio of Specific Heats |
| $PR_c$ | =Critical Pressure Ratio |
| M | =Mach Number |

Figure 5:
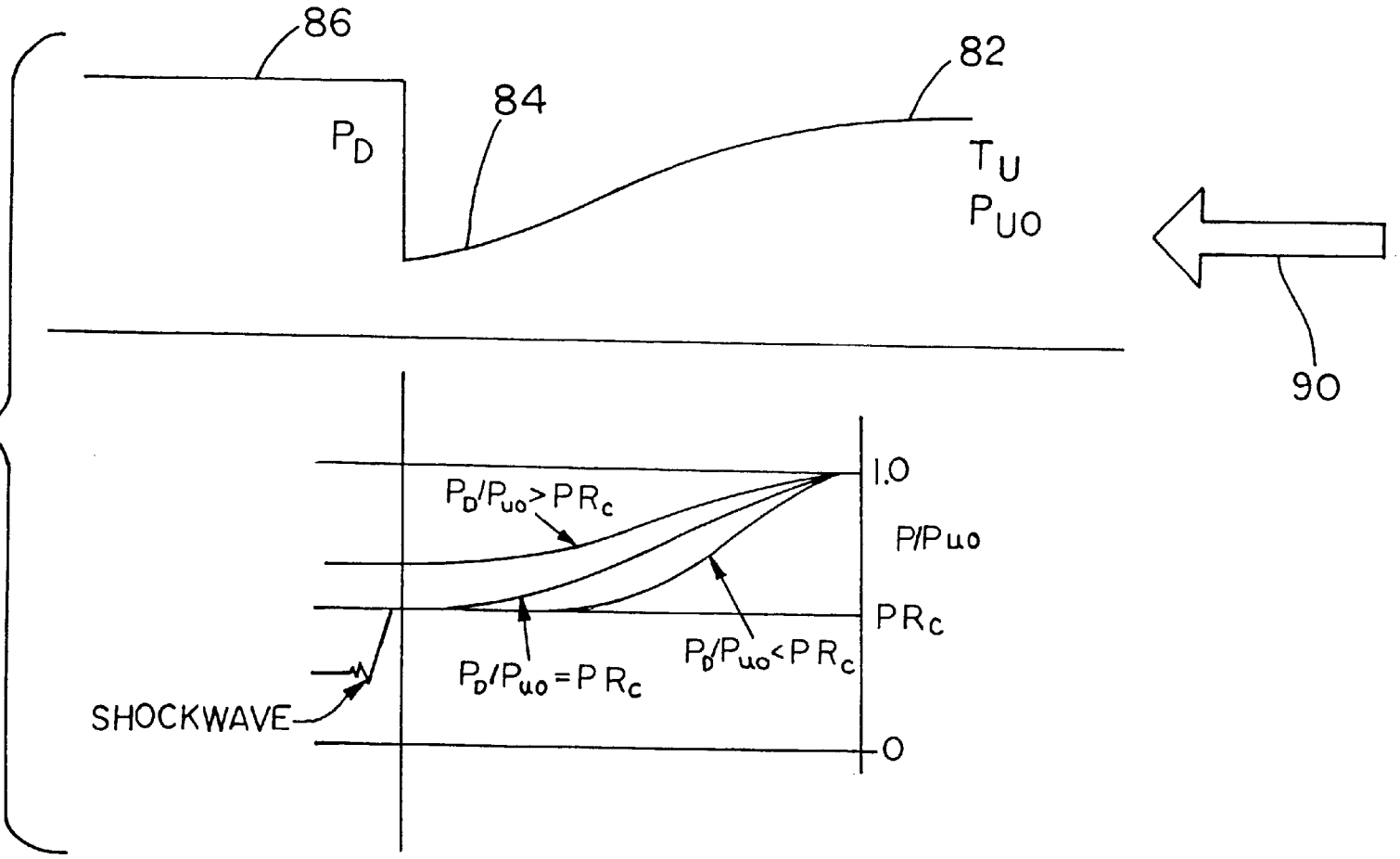
FIG. 5 is a graph of the pressure distribution within a converging nozzle of the type shown in FIGS. 1–3.

Critical flow nozzle 38 can be considered a converging nozzle as it has a convergent section, which includes upstream portion 82 and throat 46 in which the flow accelerates. FIG. 5 shows a pressure distribution along such a converging nozzle at both sonic and sub-sonic conditions, as shown by the graph of $P_{uo}$ ratios over the length of the nozzle for the possible pressure ratio conditions with respect to the critical pressure ratio $PR_c$.

Industrial Applicability

Figure 6:
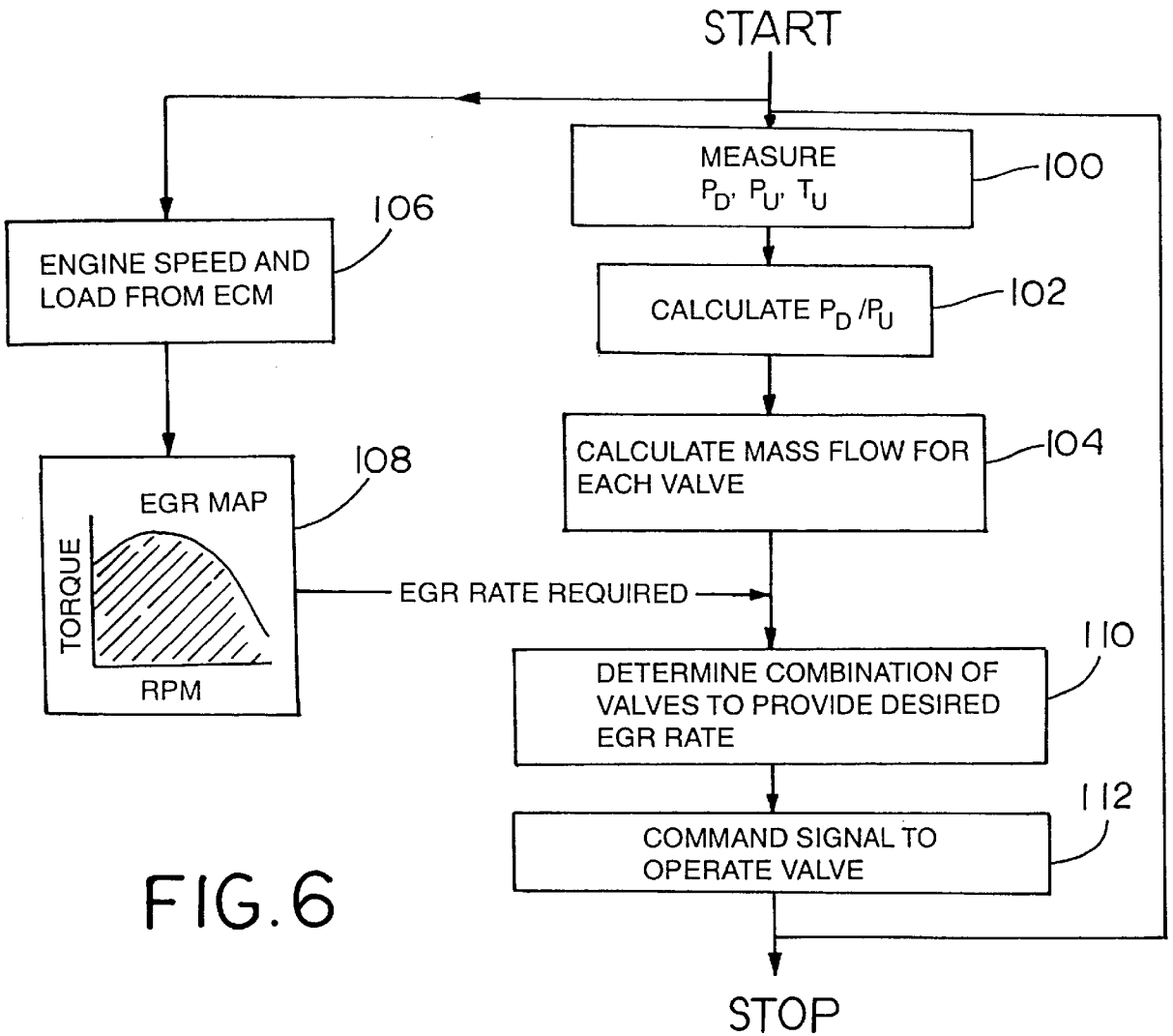
FIG. 6 is a flow chart of the operation of the EGR rate control system.

In use, as shown by the EGR rate control flow diagram of FIG. 6, values for downstream pressure $P_d$, upstream pressure $P_u$ and upstream temperature $T_u$ are measured or, alternatively, determined from a look-up map (block 100). The ratio of $P_d/P_u$ is then calculated in order to determine if the flow is sonic or sub-sonic in order to establish which mass flow equation to use for calculating the mass flow at each valve (block 102). Next, the mass flow for each valve 50 is calculated (block 104).

Concurrent to determining the mass flow for each valve 50, the required EGR rate is determined via a two-step process. First, the engine speed signal and engine load signal are received into ECM 26 via lines 52 and 54 (block 106). The engine speed and load signals are used in determining the required EGR rate from a look-up EGR map (block 108).

As shown at block 110, the combination of valves 50 needed to provide the required EGR rate is determined. Lastly, a command signal to operate the desired valve combination is generated by ECM 26 (block 112).

An advantage of the present invention is that the exhaust gas recirculation is accurately provided to an internal combustion engine with an "open-loop" control system, thereby avoiding the use of a feedback system which would require the use of an expensive, sensor to provide feedback signals. Another advantage of the present invention is that during choked-flow operating conditions, the flow can be determined accurately since the nozzle area, stagnation pressure and temperature can be accurately determined. A further advantage is that the system can handle different exhaust gas flow rates simply by providing nozzles having different throat areas. A yet further advantage is that the pressure and temperature sensors for the system may be optional with look-up maps, established from engine testing, instead being used. A yet even further advantage is that the same system may be used in both sonic and sub-sonic exhaust gas flow conditions.

Other aspects, objects and advantages of this invention can be obtained from a study of the drawings, the disclosure and the appended claims.

What is claimed is:

1. An exhaust gas recirculation rate control system adapted to be fluidly connected to an exhaust manifold and an intake manifold of an internal combustion engine, said exhaust gas recirculation rate control system comprising:

a plurality of critical-flow nozzles, each said critical-flow nozzle having an intake end and an output end, said intake ends being fluidly coupled in parallel and adapted to receive the flow of exhaust gas;

at least one valve, each said valve being fluidly coupled with at least one said output end; and a control module operatively connected to each said valve for controlling exhaust gas flow therethrough.

2. The exhaust gas recirculation rate control system of claim 1, each said critical-flow nozzle being a venturi nozzle, each said critical-flow nozzle having an upstream region with said intake end, a downstream region with said output end, and a throat fluidly interconnecting said upstream region with said downstream region.

3. The exhaust gas recirculation rate control system of claim 2, each said critical-flow nozzle having a throat area at a connective opening whereat each said throat opens into and connects with said downstream region, said critical-flow nozzles having different respective throat areas.

4. The exhaust gas recirculation rate control system of claim 2, one of said critical-flow nozzles having a first pressure sensor positioned within said upstream region, a second pressure sensor positioned within said downstream region, and a first temperature sensor positioned within said upstream region.

5. The exhaust gas recirculation rate control system of claim 4, each said critical-flow nozzle having a throat area at a connective opening whereat each said throat opens into and connects with said downstream region, said critical-flow nozzles having different respective throat areas, said one of said critical-flow nozzles having a smallest throat area of all of said critical-flow nozzles.

6. The exhaust gas recirculation rate control system of claim 1, said at least one valve being a plurality of valves, each said valve being fluidly coupled with a corresponding said output end.

7. An internal combustion engine system, comprising:

an internal combustion engine having an intake manifold and an exhaust manifold;

an exhaust gas recirculation rate control system fluidly connected to said exhaust manifold and to said intake manifold, said exhaust gas recirculation rate control system comprising:

a plurality of critical-flow nozzles, each said critical-flow nozzle having an intake end and an output end, said intake ends being fluidly coupled in parallel to said exhaust manifold;

at least one valve, each said valve being fluidly coupled with at least one said output end; and a control module operatively connected to each said valve for controlling exhaust gas flow therethrough.

8. The internal combustion engine system of claim 7, each said critical-flow nozzle being a venturi nozzle, each said critical-flow nozzle having an upstream region with said intake end, a downstream region with said output end, and a throat fluidly interconnecting said upstream region with said downstream region.

9. The internal combustion engine system of claim 8, each said critical-flow nozzle having a throat area at a connective opening whereat each said throat opens into and connects with said downstream region, said critical-flow nozzles having different respective throat areas.

10. The internal combustion engine system of claim 8, one of said critical-flow nozzles having a first pressure sensor positioned within said upstream region, a second pressure sensor positioned within said downstream region, and a first temperature sensor positioned within said upstream region.

11. The internal combustion engine system of claim 10, each said critical-flow nozzle having a throat area at a connective opening whereat each said throat opens into and connects with said downstream region, said critical-flow nozzles having different respective throat areas, said one of said critical-flow nozzles having a smallest throat area of all of said critical-flow nozzles.

12. The internal combustion engine system of claim 7, said at least one valve being a plurality of valves, each said valve being fluidly coupled with a corresponding said output end.

13. The internal combustion engine system of claim 7, including a particulate trap for filtering particulates from the exhaust gas, said particulate trap including an entrance end fluidly connected to said exhaust manifold and an exit end fluidly coupled to said plurality of critical-flow nozzles.

14. A method of controlling a rate of recirculation of a flow of an exhaust gas in an exhaust gas recirculation system, comprising the steps of:

providing a plurality of critical-flow nozzles, each said critical-flow nozzle having an intake end and an output end;

fluidly coupling said intake ends in parallel with an exhaust manifold of an internal combustion engine;

fluidly coupling at least one valve with at least one corresponding said output end and with an intake manifold of said internal combustion engine;

operatively connecting a control module to each said valve;

directing the flow of the exhaust gas into said intake ends;

controllably releasing an amount of the exhaust gas through each said valve; and recirculating the controlled amount of exhaust gas to said intake manifold.

15. The method of claim 14, including the steps of:

generating an engine speed signal and a load signal in said internal combustion engine;

receiving and processing the engine speed signal and the load signal in said control module; and determining a desired exhaust gas return rate dependent upon the engine speed signal and the load signal.

16. The method of claim 14, each said critical-flow nozzle being a venturi nozzle, each said venturi nozzle having an upstream region with an intake end, a throat, and a downstream region with an output end, said throat having a throat area $A_t$ at a connective opening whereat said throat opens into and connects with said downstream region; and including the steps of:

providing each said venturi nozzle with a different throat area; and accommodating a different exhaust gas flow rate with each said venturi nozzle.

17. The method of claim 14, each said critical-flow nozzle being a venturi nozzle, each said critical-flow nozzle having an upstream region with an intake end, a throat, and a downstream region with an output end, said throat having a throat area $A_t$ at a connective opening whereat said throat opens into and connects with said downstream region, one of said critical-flow nozzles having a stagnation pressure $P_{uo}$ and a stagnation temperature $T_{uo}$ near an upstream entrance of said upstream region thereof; and including the step of calculating an actual exhaust gas mass flow rate through said one of said critical-flow nozzles based upon values for the throat area $A_t$, the stagnation pressure $P_{uo}$, and the stagnation temperature $T_{uo}$ of said one of said critical-flow nozzles.

18. The method of claim 17, including the steps of:

determining a static pressure $P_t$ at said throat of said one of said critical-flow nozzles;

calculating a pressure ratio PR by dividing the static pressure $P_t$ at said throat of said one of said critical-flow nozzles by the stagnation pressure $P_{uo}$ to determine a pressure ratio PR, whereby a pressure ratio PR less than or equal to a critical pressure ratio $PR_c$ indicates a choked-flow condition at said throat of said one of said critical-flow nozzles.

19. The method of claim 17, including the steps of:

providing each said critical-flow nozzle with a different throat area;

accommodating a different exhaust gas flow rate with each said critical-flow nozzle; and choosing a critical-flow nozzle with the smallest throat area of all of said critical-flow nozzles as said one of said critical-flow nozzles.

20. The method of claim 19, including the steps of:

providing each said critical-flow nozzle with a valve;

calculating a mass flow rate for each said critical-flow nozzle;

processing an engine speed signal and a load signal received from said internal combustion engine to establish a desired exhaust gas return rate;

determining a combination of said valves that needs to be opened to provide the desired exhaust gas return rate; and signaling for said combination of said valves to be opened.

* * * * *